US005085340A

United States Patent [19]

Doxey et al.

[11] Patent Number: 5,085,340

[45] Date of Patent: Feb. 4, 1992

[54] SYSTEM FOR LOCKING A WASTE RECEPTACLE

[75] Inventors: André G. Doxey, Shaker Heights; John L. Hradisky, Medina, both of Ohio

[73] Assignee: Rubbermaid Incorporated, Wooster, Ohio

[21] Appl. No.: 635,744

[22] Filed: Dec. 28, 1990

[51] Int. Cl.[5] ..... B65D 41/06

[52] U.S. Cl. ..... 220/298; 220/94 A; 220/908; 215/222

[58] Field of Search ..... 220/908, 298, 299, 94 A; 215/222

[56] References Cited

U.S. PATENT DOCUMENTS

| | | | |
|---|---|---|---|
| 1,611,443 | 12/1926 | Hothersall | 220/298 |
| 1,715,861 | 6/1929 | Owen | 220/908 |
| 1,903,632 | 4/1933 | Oliver | 215/222 |
| 2,627,997 | 2/1953 | Wittenberg | 220/298 |
| 2,845,477 | 7/1958 | Kelley et al. | 220/298 |
| 2,907,491 | 10/1959 | Gunn | 220/298 |
| 4,390,110 | 6/1983 | Pirro | 220/318 |
| 4,473,170 | 9/1984 | Ciancimino | 220/908 |
| 4,501,376 | 2/1985 | Bushby | 220/298 |
| 4,691,840 | 9/1987 | Ferbrache | 220/318 |
| 4,819,827 | 4/1989 | DiSesa | 220/318 |
| 5,004,114 | 4/1991 | Terbrusch et al. | 220/908 |

OTHER PUBLICATIONS

Tucker Housewares, Subsidiary of Kidde, Inc., 25 Tucker Drive, Leominster, Massachusetts 01453; 2 page brochure; date unknown.

Tucker Housewares, AMS Industries, Subsidiary of Kidde, Inc., 345 Central Street, Leominster, Massachusetts 01453; 5 pages of a catalog; date unknown.

*Primary Examiner*—Gary E. Elkins
*Assistant Examiner*—S. Castellano
*Attorney, Agent, or Firm*—Renner, Kenner, Greive, Bobak, Taylor & Weber

[57] ABSTRACT

A waste receptacle (10) includes a generally cylindrical base container portion (12) having a generally circular open top (15) and a generally circular cover (11) for closing the open top (15). A plurality of circumferentially spaced lug members (24) extend radially outwardly from an upper skirt (17) of the base container and include nubs (26) extending downwardly from the circumferential ends thereof. The cover (11) has a lower skirt (32) with inwardly directed locking lugs (35) circumferentially spaced thereon, the spacing being generally the same as the spacing of the lug members (24). The cover (11) is placed on the base container portion (12) with its locking lugs (35) not aligned with the lug members (24) of the base container portion (12). Then upon rotation of the cover (11), its locking lugs (35) will first engage the nubs (26) of the lug members (24) of the base container portion (12) and upon further rotation, the locking lugs (35) will be positioned under each of the lug members (24) and between the nubs (26) thereof to lock the cover (11) onto the base container portion (12).

14 Claims, 3 Drawing Sheets

SYSTEM FOR LOCKING A WASTE RECEPTACLE

TECHNICAL FIELD

This invention relates to a waste receptacle or refuse container having a unique system for locking the container cover to the base. More particularly, this invention relates to a cover which is lockable to the container base without the need for additional parts, hardware or the like.

BACKGROUND ART

Many waste receptacles or refuse containers which are provided with covers are also provided with a means to temporarily lock or affix the cover to the base of the container. Quite often such means take the form of a simple pressure fit, that is, the cover is merely snapped down onto the container base. The problem with this type of connection is that the force needed to secure the cover is the same force needed to release it. Thus, if for convenience of the user minimal force requirements are engineered into the product, the cover can be too easily and possibly accidentally released. If the types of force requirements are designed into the product which will securely hold the cover in place, usually it becomes too difficult for the average person to easily generate enough force to affix the cover.

As an alternative to the snap lock type of securing system, attempts have been made to provide base portions of waste receptacles with threads to be engaged by a similarly threaded cover much like typical household jars. However, not only do such threads add significantly to the cost of the product, but also the threads on such large containers as waste receptacles, particularly when made of the most commonly accepted plastic materials, will either not provide sufficient strength to permit the waste receptacle to be carried by the cover, if desired, or will quickly wear limiting the useful life thereof.

As a result of the disadvantages of the designs heretofore described, many waste receptacles have been provided with additional hardware or other devices so that the cover may be secured to the base container. For example, oftentimes the locking function is combined with a handle function such as shown in U.S. Pat. No. 4,691,840. In that patent rotatable handles serve to lock the cover to the base and then, when locked, the receptacle can be conveniently transported. While such a system has proved to be a superior design over those described above, the handle mechanisms employed add significantly to the cost of manufacturing and assembling the product.

Finally, the designs of most all of the prior art containers, of their very nature or configuration, render it difficult, if not impossible, to stack a plurality of covers in a confined area as might be desirable for shipment and/or display.

DISCLOSURE OF THE INVENTION

It is thus a primary object of the present invention to provide a system of locking a cover to the base container portion of a waste receptacle without the need for additional locking mechanisms or hardware in addition to the cover and base container portion themselves.

It is another object of the present invention to provide a system, as above, which is easy for the user to employ.

It is an additional object of the present invention to provide a system, as above, which results in a strong and sturdy attachment of the cover to the base container portion of the waste receptacle.

It is a further object of the present invention to provide a system, as above, which is economical to manufacture and does not require any special assembly procedures.

It is a related object of the present invention to provide a system, as above, in which the receptacle cover is not only designed to be conveniently locked to the base portion but also at the same time is designed to be conveniently stacked with like covers for shipment and display purposes.

These and other objects of the present invention, as well as the advantages thereof over existing prior art forms, which will become apparent from the description to follow, are accomplished by the means hereinafter described and claimed.

In general, a waste receptacle according to the concepts of the present invention includes a generally cylindrical base container portion defined by generally vertical walls forming a generally circular open top. A generally circular cover is designed to close the open top and includes a plurality of circumferentially spaced locking lug members. The base container portion also is provided with a plurality of similarly circumferentially spaced lug members such that when the cover is placed on the base container portion, the locking lug members are adapted to be located under and engaged by the lug members on the base container portion to hold the cover on the base container portion.

A preferred exemplary waste receptacle incorporating the concepts of the present invention is shown by way of example in the accompanying drawings without attempting to show all the various forms and modifications in which the invention might be embodied, the invention being measured by the appended claims and not by the details of the specification.

BRIEF DESCRIPTION OF THE DRAWINGS

FIG. 5 is a partially cross-sectioned, broken away, somewhat schematic, elevational view taken substantially at 90° of the direction from which FIG. 3 is taken and showing the manner in which a plurality of covers of the waste receptacle of FIG. 1 may be conveniently stacked.

PREFERRED EMBODIMENT FOR CARRYING OUT THE INVENTION

Figure 1:
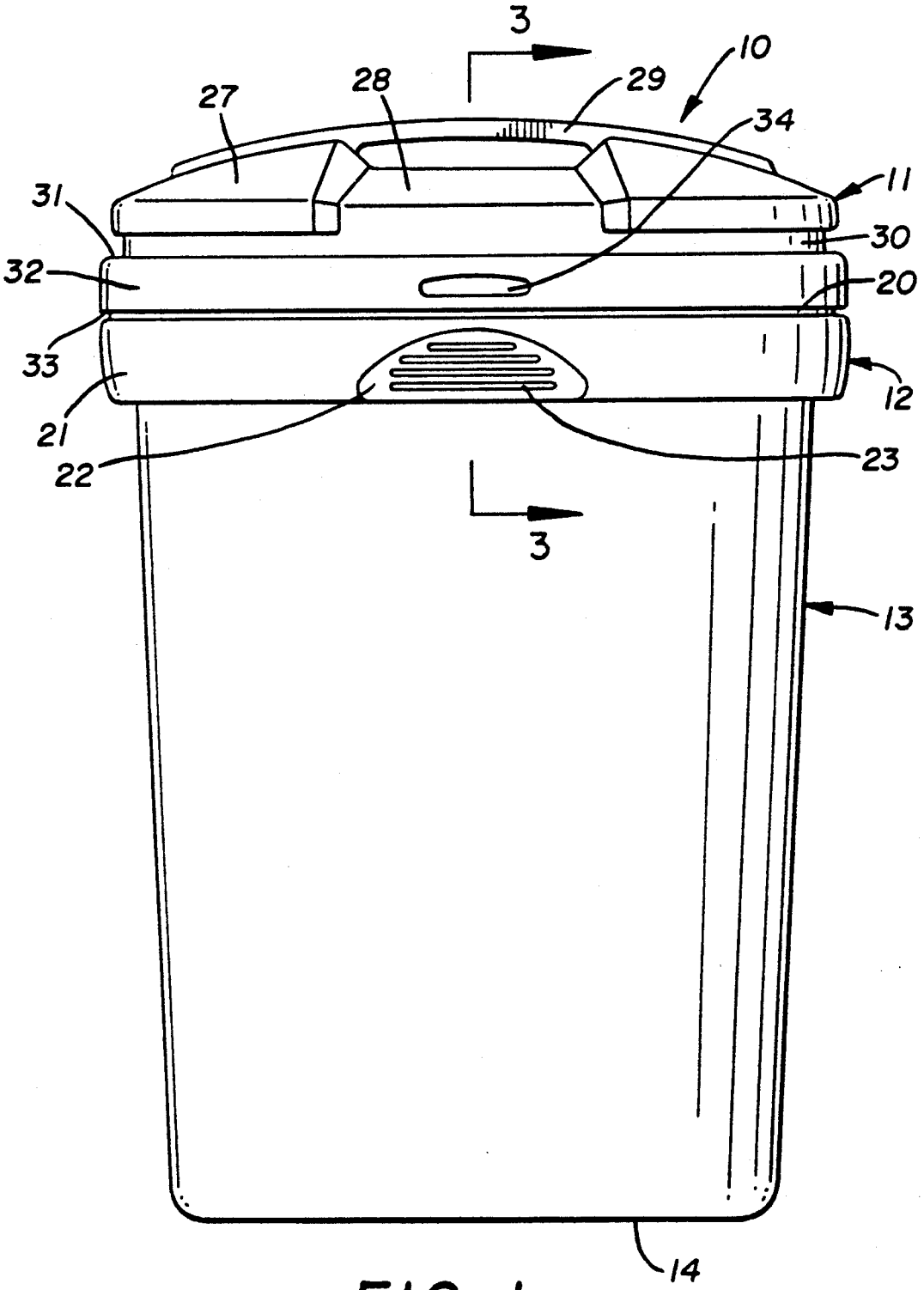
FIG. 1 is an elevational view of a waste receptacle made in accordance with the concepts of the present invention.

A waste receptacle according to the concepts of the present invention is generally indicated by the numeral 10 in FIG. 1 and includes a cover, generally indicated by the numeral 11, and a base container portion generally indicated by the numeral 12. Waste receptacle 10 is preferably molded of any suitable plastic material as would be well known to one of ordinary skill in the art.

Figure 2:
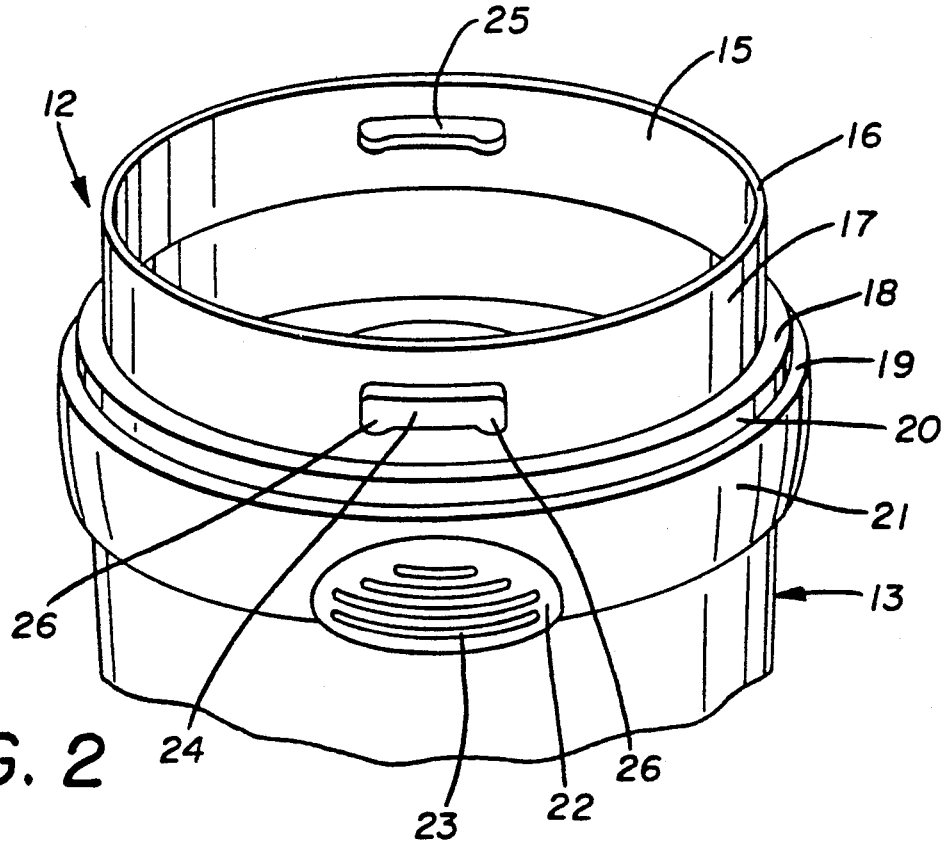
FIG. 2 is a fragmented perspective view of the waste receptacle of FIG. 1 with the cover removed.

Base container portion 12 of waste receptacle 10 is shown as being generally cylindrical in configuration having side walls indicated generally by the numeral 13 which extend generally vertically upwardly from a bottom surface 14 to define, at the top thereof, a generally circular open top 15. As best shown in FIG. 2, open top 15 is defined by an upper rim 16 at the top of a downwardly directed upper skirt 17 which is positioned as the uppermost extremity of side walls 13. An upper ledge 18 extends peripherally and generally horizontally outward from upper skirt 17 and is separated from a similar lower ledge 19 by an intermediate downwardly directed skirt 20. Lower ledge 19 defines the upper surface of a lower skirt or band 21 which is positioned radially outwardly of the major portions of side walls 13. Side walls 13 are also provided with preferably two diametrically opposed handles 22 (one shown) which extend outwardly from lower skirt 21. Handles 22 provide a convenient means by which base portion 12 or the entire receptacle 10 including cover 11 may be transported by the user. In this regard, handles 22 may be provided with a plurality of grip assisting ribs 23 on the exterior thereof.

To assist in locking cover 11 to base portion 12, as will hereinafter be described, projecting lugs 24 extend generally radially outwardly from upper skirt 17 from at least two circumferentially spaced locations on skirt 17. As shown, it is preferred that these locations be diametrically opposed and preferably at the same circumferential location as handles 22 for reasons that will hereinafter become evident. As shown, primarily for convenience of molding, lugs 24 are hollow and are defined by complementary shaped recesses 25 on the inside of upper skirt 17. The lower circumferentially outer portions of each lug 24 is provided with locating and locking nubs 26, the purpose of which will be hereinafter described.

Cover 11 is generally circular in configuration and is shown as having a generally domed upper surface 27 interrupted by a diametrically extending recess 28 therein. A cover handle 29 spans recess 28 thereby extending generally transversely across recess 28 and diametrically across cover 11. Handle 29 provides a convenient means by which the user can conveniently transport the cover when not attached to base portion 12 and if desired, the user could even transport the entire waste receptacle 10, with cover 11 attached to base portion 12, by utilizing handle 29.

At the outer periphery of domed upper surface 27 and at the radially outer portions of recess 28, as well, cover 11 is provided with a generally vertically oriented downturned upper skirt 30 which preferably tapers outwardly from the top to the bottom thereof. The lower portion of skirt 30 flares outwardly to form a ledge 31 which then turns downwardly to form a generally vertically oriented downturned lower skirt 32. Lower skirt 32 also tapers slightly outwardly and terminates as a lower lip 33 of cover 11.

Figure 4:
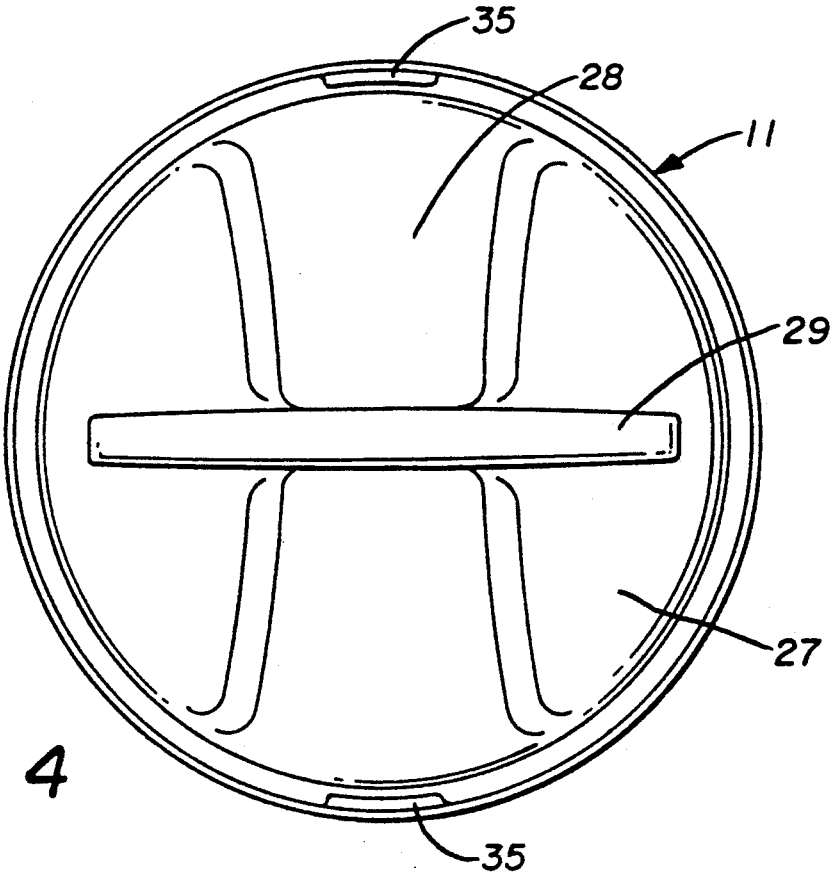
FIG. 4 is a bottom plan view of the cover of the waste receptacle of FIG. 1.

As shown in FIG. 1, lower skirt 32 is provided with at least two circumferentially spaced generally oval slots or depressions 34 therein (one shown). The circumferential spacing of slots 34 is intended to be the same spacing as lugs 24 on skirt 17 of base container portion 11. Thus, in the preferred form there are two diametrically opposed slots 34 in lower skirt 32. As shown in FIG. 4, depressions 34 form diametrically opposed, radially inwardly directed, locking lugs 35. In order to lock cover 11 on base container portion 12, cover 11 is first oriented so that its locking lugs 35 are not aligned with projecting lugs 24 on upper skirt 17 of base portion 12. This is readily visually accomplished either by directly observing the location of lugs 24 relative to depressions 34 and locking lugs 35 or even by observing the location of handles 22, which are preferably aligned with lugs 24, relative to depressions 34 and 35. Then cover 11 may be easily lowered onto base portion 12 such that upper skirt 30 and lower skirt 32 envelop upper skirt 17 and lower skirt 20 of base portion 12. At this position, lower cover lip 33 is adjacent to and spaced just above lower ledge 19 of base portion 12.

Figure 3:
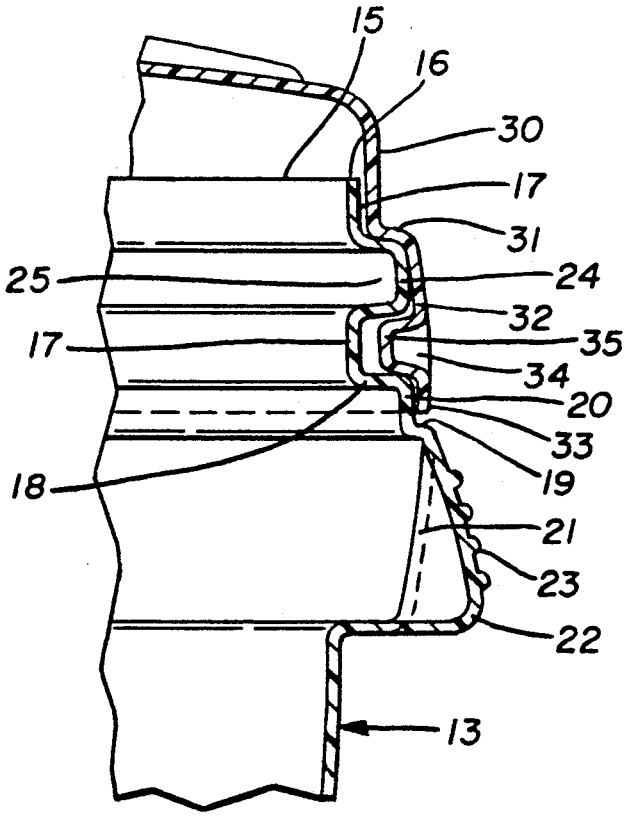
FIG. 3 is a fragmented sectional view taken substantially along line 3—3 of FIG. 1.

Then cover 11 may be rotated in either direction to the FIG. 3 position so that cover locking lugs 35 are underneath and engaged by projecting lugs 24 of base portion 12 to affix cover 11 thereto. Positively positioning cover 11 in this locking position is assured in several ways. First, as cover 11 is being rotated, locking lugs 35 will initially come into contact with a nub 26 of each opposed projecting lug 24 which slightly interfere with the rotating path of lugs 35. Not only can the user feel this slight interference, but also an audible sound of the initial interference contact can also be detected. Continued rotation of cover 11 overcomes the interference of nubs 26 until lugs 35 are squarely positioned underneath each projecting lug 24 and between the nubs 26 thereof. Again, this positioning can usually be sensed audibly as well as being felt by the user. Finally, the user is also assured that the locked position has been reached when the depressions 34 which define and otherwise locate internal lugs 35 are aligned with handles 22. To unlock the system, all that is required is rotation of cover 11 in either direction so that locking lugs 35 pass over nubs 26.

As previously indicated, it should be appreciated that waste receptacle 10 could be provided with almost any number of engaging sets of lugs 24 and 35 as long as lugs 24 are spaced the same circumferential distance around skirt 17 as the spacing between lugs 35 on skirt 32. For example, two or even three pairs of diametrically opposed sets of lugs could be provided, or three lugs spaced at 120° of each other could be provided without departing from the spirit of this invention, it only being important that there be more than one set of engaging lugs to assure locking.

Figure 5:
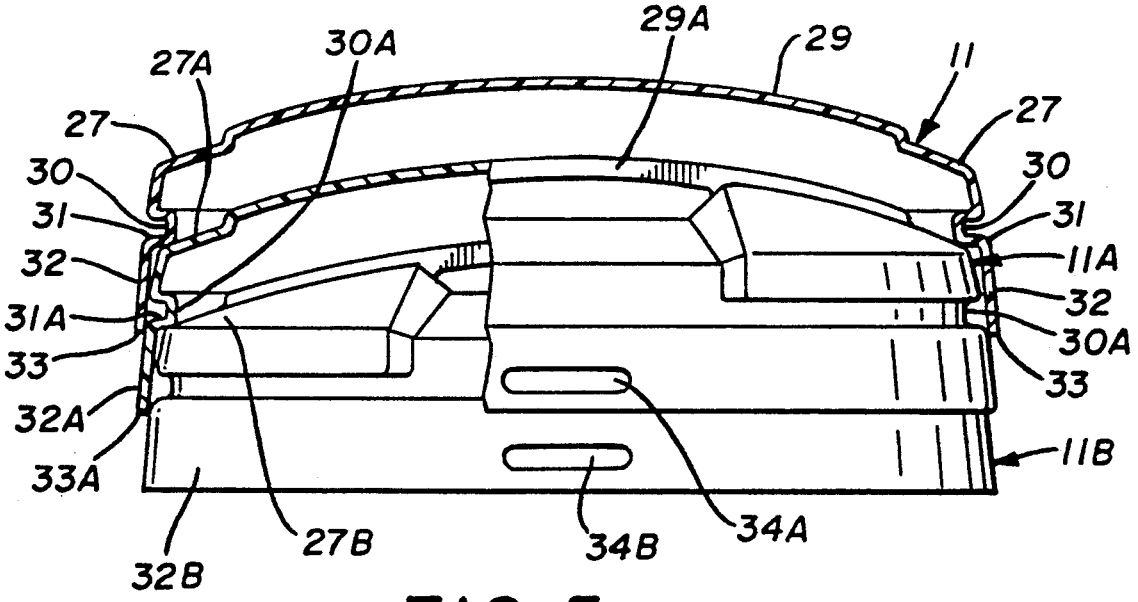

In addition to being uniquely configured to lock onto base portion 12, cover 11 is configured so as to conveniently nest or stack with like covers as shown in FIG. 5. In that view, which shows a partial cross-section of cover 11 taken in a direction through and parallel to cover handle 29, and therefore not viewing cover 11 at the location of depressions 34 and locking lugs 35 as seen in FIG. 3, cover 11 is shown stacked on like covers 11A and 11B, with all of the other depicted components of covers 11A and 11B being given the same reference numerals of cover 11 followed by the A and B suffixes. When stacked, as shown in FIG. 5, ledge 31 of cover 11 rests near the outer edge of domed top 27A of cover 11A and its ledge 31A rests near the outer edge of domed top 27B of cover 11B and so forth depending on the number of stacked covers. Likewise, skirt 32 surrounds and otherwise envelops the lower end of domed top 27A and upper skirt 30A with lip 33 resting on the outer top edge of skirt 32A just below ledge 31A. Because skirts 30, 30A, 30B as well as skirts 32, 32A, and 32B etc. taper slightly outwardly as they extend downwardly, the stack of cover 11, 11A and 11B etc. has a generally vertical outer periphery or profile. Thus, there is no cascading effect when multiple covers are stacked and any number of covers may be conveniently stacked for display, shipment or other purposes as may be desired.

It should thus be evident that a waste receptacle constructed with the locking system according to the concepts of the present invention accomplishes the objects of the present invention and otherwise substantially improves the art.

We claim:

1. A receptacle comprising a generally cylindrical base container portion defined by generally vertical walls forming a generally circular open top, a generally circular cover for closing said open top, a plurality of circumferentially spaced lug means extending outwardly from said base container portion, handles extending outwardly from said base container portion and aligned with said lug means, nub means extending downwardly from each said lug means, and a plurality of similarly spaced locking lug means on said cover defined by slots in said cover, said locking lug means on said cover being adapted to abut said nub means and engage said lug means in a single locked position by aligning said slots with said handles to hold said cover on said base container portion.

2. A receptacle according to claim 1 wherein said nub means includes nub members extending downwardly from said lug means on said base container portion near the circumferential edges thereof, said nub members partially interfering with said locking lug means on said cover to positively locate said locking lug means on said cover below said lug means on said base container portion.

3. A receptacle according to claim 1 wherein said generally vertical walls of said base container portion include an upper skirt, the top of which defines said open top, said lug means on said base container portion extending generally radially outwardly from said upper skirt at said plurality of spaced positions thereon.

4. A receptacle according to claim 3 wherein said cover includes a lower skirt, said locking lug means on said cover extending generally radially inwardly from said lower skirt at said plurality of similarly spaced positions thereon.

5. A receptacle according to claim 4 wherein said nub means includes nub members extending downwardly from said lug means on said base container portion near the circumferential edges thereof, said nub members partially interfering with said locking lug members on said cover to positively locate said locking lug means on said cover below said lug means on said base container portion.

6. A receptacle according to claim 4 wherein said generally vertical walls of said base container portion include a lower skirt from which said handles extend.

7. A receptacle comprising a generally cylindrical base container portion defined by generally vertical walls forming a generally circular open top, a generally circular cover for closing said open top, a downwardly directed skirt on said cover, diametrically opposed lug means extending outwardly from said base container portion, diametrically opposed handles extending outwardly from said base container and aligned with said lug means, and diametrically opposed locking lug means on said cover defined by diametrically opposed slots in said skirt of said cover, said locking lug means on said cover being adapted to be located under and engaged by said lug means on said base container portion by aligning said slots with said handles and thereby holding said cover on said base container portion.

8. A receptacle according to claim 1 wherein said cover includes a generally domed top, a diametrical extending recess in said domed top, and a cover handle extending transversely across said recess.

9. A receptacle according to claim 1 wherein said cover has a top surface, an upper skirt extending downwardly from said top surface forming a ledge near the bottom thereof, and a lower skirt extending downwardly from said ledge having a lower lip thereon.

10. A receptacle according to claim 9 wherein said upper skirt and said lower skirt taper outwardly as they extend downwardly so that said cover can be stacked on a like cover, when so stacked said edge resting on the outer edge of the top surface of a like container and said lower lip resting on the outer periphery of the lower skirt of the like container.

11. A receptacle comprising a generally cylindrical base container portion defined by generally vertical walls forming a generally circular open top, opposed handles extending outwardly from said walls, a generally circular cover for closing said open top, downwardly directed skirt means on said cover, a plurality of circumferentially spaced lug members extending outwardly from said walls, interference nubs extending downwardly from said lug members, a plurality of similarly spaced locking lug members extending generally radially inwardly from said skirt means of said cover and defined by opposed slots in said skirt means, said locking lug members being adapted to be engaged by said lug members on said walls of said base container portion such that when said cover is placed on said base container portion with said locking lug members not aligned with said lug members, rotation of said cover will first cause said locking lug members to be engaged by said nubs and then further rotation will position each said locking lug member between said nubs of each lug member and under each lug member at which time said slots are aligned with said handles.

12. A receptacle according to claim 11 wherein said cover includes a generally domed top, a diametrical extending recess in said domed top, and a cover handle extending transversely across said recess.

13. A receptacle according to claim 11 wherein said cover has a top surface, wherein said skirt means includes an upper skirt extending downwardly from said top surface forming a ledge near the bottom thereof, and a lower skirt extending downwardly from said ledge having a lower lip thereon.

14. A receptacle according to claim 13 wherein said upper skirt and said lower skirt taper outwardly as they extend downwardly so that said cover can be stacked on a like cover, when so stacked said ledge resting on the outer edge of the top surface of a like container and said lower lip resting on the outer periphery of the lower skirt of the like container.

* * * * *